US006514342B2

(12) United States Patent
Kozarek et al.

(10) Patent No.: US 6,514,342 B2
(45) Date of Patent: Feb. 4, 2003

(54) LINEAR NOZZLE WITH TAILORED GAS PLUMES

(75) Inventors: Robert L. Kozarek, Apollo, PA (US); William D. Straub, Pittsburgh, PA (US); Joern E. Fischer, Bremen (DE); David D. Leon, Murrysville, PA (US)

(73) Assignee: Alcoa Inc., Pittsburgh, PA (US)

( * ) Notice: Subject to any disclaimer, the term of this patent is extended or adjusted under 35 U.S.C. 154(b) by 82 days.

(21) Appl. No.: 09/774,910

(22) Filed: Jan. 31, 2001

(65) Prior Publication Data

US 2001/0020446 A1 Sep. 13, 2001

Related U.S. Application Data

(63) Continuation-in-part of application No. 09/378,885, filed on Aug. 23, 1999, now Pat. No. 6,258,166, which is a continuation-in-part of application No. 08/915,230, filed on Aug. 20, 1997, now Pat. No. 5,968,601.

(51) Int. Cl.[7] ..... B05C 5/02

(52) U.S. Cl. ..... 118/315; 118/324; 239/76; 239/82; 239/296; 239/543; 239/544; 239/545; 239/590.3; 239/590.5; 164/271

(58) Field of Search ..... 118/315, 324; 239/8, 296, 543–545, 566, 590.3, 590.5, 76, 82; 164/46, 479, 271; 427/424, 427

(56) References Cited

U.S. PATENT DOCUMENTS 3,826,301 A * 7/1974 Brooks ..... 164/46
3,905,734 A * 9/1975 Blair ..... 264/214
4,078,103 A * 3/1978 Thornton et al. ..... 118/63
4,485,834 A * 12/1984 Grant ..... 164/46
4,527,613 A * 7/1985 Bedell et al. ..... 164/263
4,539,930 A * 9/1985 Stuck et al. ..... 118/300
4,901,784 A * 2/1990 Ashok et al. ..... 118/302
5,071,067 A * 12/1991 Larsson ..... 239/296
5,115,972 A * 5/1992 Maier et al. ..... 239/297
5,201,420 A * 4/1993 Thaler et al. ..... 206/447
5,429,840 A * 7/1995 Raterman et al. ..... 118/324
5,480,097 A * 1/1996 Carter et al. ..... 239/296
5,595,765 A * 1/1997 Christensen et al. ..... 222/603
5,656,061 A * 8/1997 Miller et al. ..... 75/337
5,718,863 A * 2/1998 McHugh et al. ..... 164/19
6,135,194 A * 10/2000 Flinn et al. ..... 164/46

FOREIGN PATENT DOCUMENTS

JP 405138078 * 6/1993

* cited by examiner

*Primary Examiner*—Laura Edwards
(74) *Attorney, Agent, or Firm*—Julie W. Meder; Gary P. Topolosky

(57) ABSTRACT

There is claimed a method for depositing fluid material from a linear nozzle in a substantially uniform manner across and along a surface. The method includes directing gaseous medium through said nozzle to provide a gaseous stream at the nozzle exit that entrains fluid material supplied to the nozzle, said gaseous stream being provided with a velocity profile across the nozzle width that compensates for the gaseous medium's tendency to assume an axisymmetric configuration after leaving the nozzle and before reaching the surface. There is also claimed a nozzle divided into respective side-by-side zones, or preferably chambers, through which a gaseous stream can be delivered in various velocity profiles across the width of said nozzle to compensate for the tendency of this gaseous medium to assume an axisymmetric configuration.

20 Claims, 6 Drawing Sheets

LINEAR NOZZLE WITH TAILORED GAS PLUMES

CROSS REFERENCE TO RELATED APPLICATIONS

This application is a continuation-in-part of application Ser. No. 09/378,885 filed on Aug. 23, 1999 now U.S. Pat. No. 6,258,166, which is a continuation-in-part of application Ser. No. 08/915,230, filed on Aug. 20, 1997, now U.S. Pat. No. 5,968,601, the disclosures of which are fully incorporated by reference herein.

This invention was made with Government support under Contract No. DE-FC07-94ID13238 awarded by the Department of Energy. The Government has certain rights in this invention.

BACKGROUND OF THE INVENTION

The present invention generally relates to linear nozzles, i.e., nozzles having a straight, elongated opening, and a tailored gas plume exiting the nozzle for the entrainment and deposition of an atomized liquid material carried in the gas plume.

Linear nozzles can be used for producing spray formed sheet and plate, particularly aluminum sheet and plate, the nozzles depositing molten metal material on a planar surface and substrate. The substrate supports the molten metal until solidification, and acts as a heat sink in the cooling and solidifying process. Linear nozzles have the advantage of making the sheet at desired widths and at production rates that compete with the traditional breakdown and hot rolling of cast ingots. The molten metal is deposited by entrainment in a flow of a gaseous medium directed through the atomizing nozzle and to the substrate.

Linear nozzles can also be used to spray and deposit other atomizable liquid materials, such as coolants, paints, protective coatings or irrigants on the appropriate surfaces.

The velocity profile of the gas flow or plume exiting the nozzle determines the deposit profile independently of the configuration of the supply of liquid medium to the nozzle. In addition, it has been determined that a flat, gas plume will become axisymmetric (circular) downstream of the nozzle due to gas entrainment. Entrainment is more pronounced at the ends or edges of the nozzle so that the gas decelerates at a relatively faster rate at the ends or edges of the plume in comparison to rate of deceleration near and at the plume center. This phenomena is shown in FIG. 1 of the accompanying drawings. The result is a gaussian distribution of the liquid material on the substrate, as shown in FIG. 1.

Prior art efforts to overcome the problem has included the use of a plurality of axisymmetric nozzles scanning over the substrate. Other systems have included multiple nozzles to "fill in" low mass areas of the deposited material, while linear nozzles, using single chamber/single pressure schemes have involved changing the physical geometry of the gas exit of the nozzle for the purpose of controlling the distribution of deposited material. None of these efforts have produced the profile and yield properties needed at required production rates. "Yield" refers to the percent recovery of the liquid as a deposit.

SUMMARY OF THE INVENTION

By tailoring the gas velocity profile across the width of a linear nozzle, compensation for gas entrainment can be provided that ensures a substantially uniform deposit of the liquid material on a substrate. This can be accomplished by dividing the nozzle into compartments and directing gas flow through the respective compartments at conditions that will level or flatten the gas plume to make uniform the velocity of said gas plume at or near the point of liquid material deposition, thereby resulting in a more level or even deposition of said liquid material onto its substrate. The tailored gas configuration actually pushes downstream, or postpones, the natural tendency of a gaseous stream to assume an axisymmetric configuration and the resultant uneven (gaussian) deposit of liquid material on the substrate caused by an axisymmetric gaseous stream.

In a preferred embodiment, size of the individual chambers are controlled by partitions. These partitions are individually movable within the body of the nozzle to adjust and tailor the exit width of the gas leaving the compartments.

When creating long stretches of aluminum sheet or plate, the substrate can be moved relative to the nozzle at substantial speeds, or vice-versa, the nozzle can be moved, the process (again) providing an flatter, more planar deposit of liquid on the traveling substrate in both crosswise and lengthwise directions of the substrate. In this manner effective control of the gauge of the sheet or plate (after the liquid solidifies) is effected. Similarly, the embodiment can be used to provide an even application of other liquid metals or fluids.

BRIEF DESCRIPTION OF THE DRAWINGS

The invention, along with its advantages and objectives, will be better understood from consideration of the following detailed description and the accompanying drawings in which.

DESCRIPTION OF PREFERRED EMBODIMENTS

Figure 1:
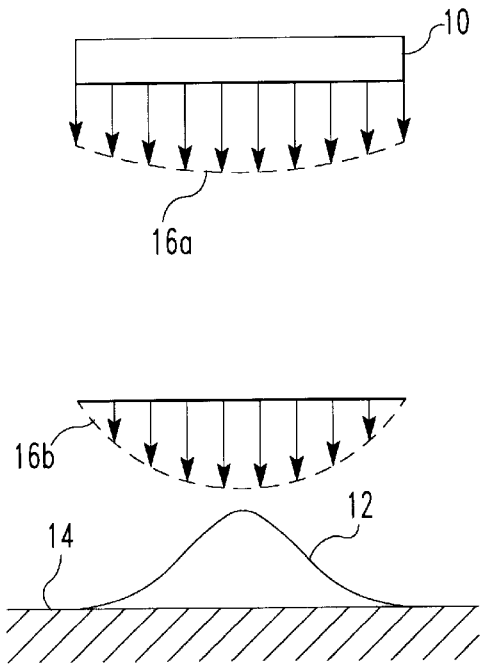
FIG.1 PRIOR ART
FIG. 1 is a schematic representation of a prior art linear nozzle, the standard gas stream velocity profile out of the nozzle and the gas stream velocity profile downstream as it approaches a planar substrate to produce a deposit having a generally gaussian distribution of material on said substrate.

Referring now to the drawings, FIG. 1 shows the effects of the problem with linear gas nozzles 10 in depositing a material 12 on a surface 14. Because of excessive deceleration of a gas stream 16*a* near the ends of a linear nozzle, the configuration of the gas stream changes from an elongated to an arcuate pattern, as represented by downstream gas pattern 16*b,* before reaching the substrate or target surface 14. This, in turn, causes the gaussian, bell-shaped distribution of the deposited material shown in FIG. 1.

Figure 2:
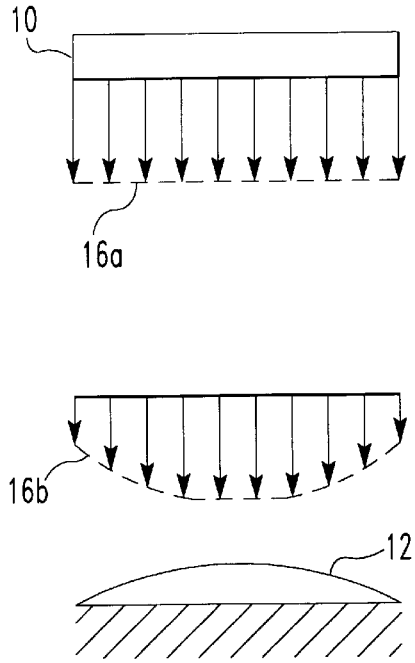
FIG.2 PRIOR ART
FIG. 2 is a schematic representation of a more recent art nozzle having an intentionally straightened gas stream velocity profile for minimizing the gaussian distribution of material deposited downstream on a substrate.

FIG. 2 shows schematically the effects of somewhat straightening, or flattening, the velocity profile of a gas 16*a* exiting a nozzle 10, resulting in subsequent gas pattern 16*b,* for minimizing the gaussian distribution of material 12 being deposited on surface 14.

Figure 3:
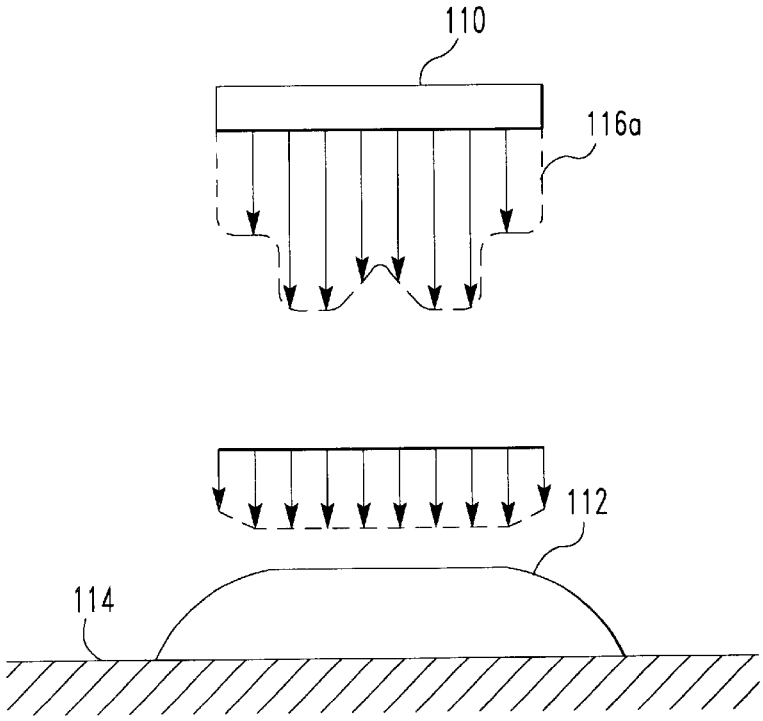
FIG. 3 shows a tailored gas profile downstream from a preferred linear nozzle according to this invention which gives a level, even or more consistently flatter deposit profile of material on its substrate.

FIG. 3 shows the preferred velocity profile 116*a* of a gas exiting a linear nozzle 110*a* in accordance with this invention, for achieving the desired subsequent gas pattern 116*b* that results in a more evenly deposited material 112*a* on planar surface 114. This is effected by a gas velocity pattern that is relatively even but somewhat slower near the edge of the nozzle than the center portions of the nozzle, which are also relatively even except for a slight dip in velocity at the nozzle center.

Figure 4:
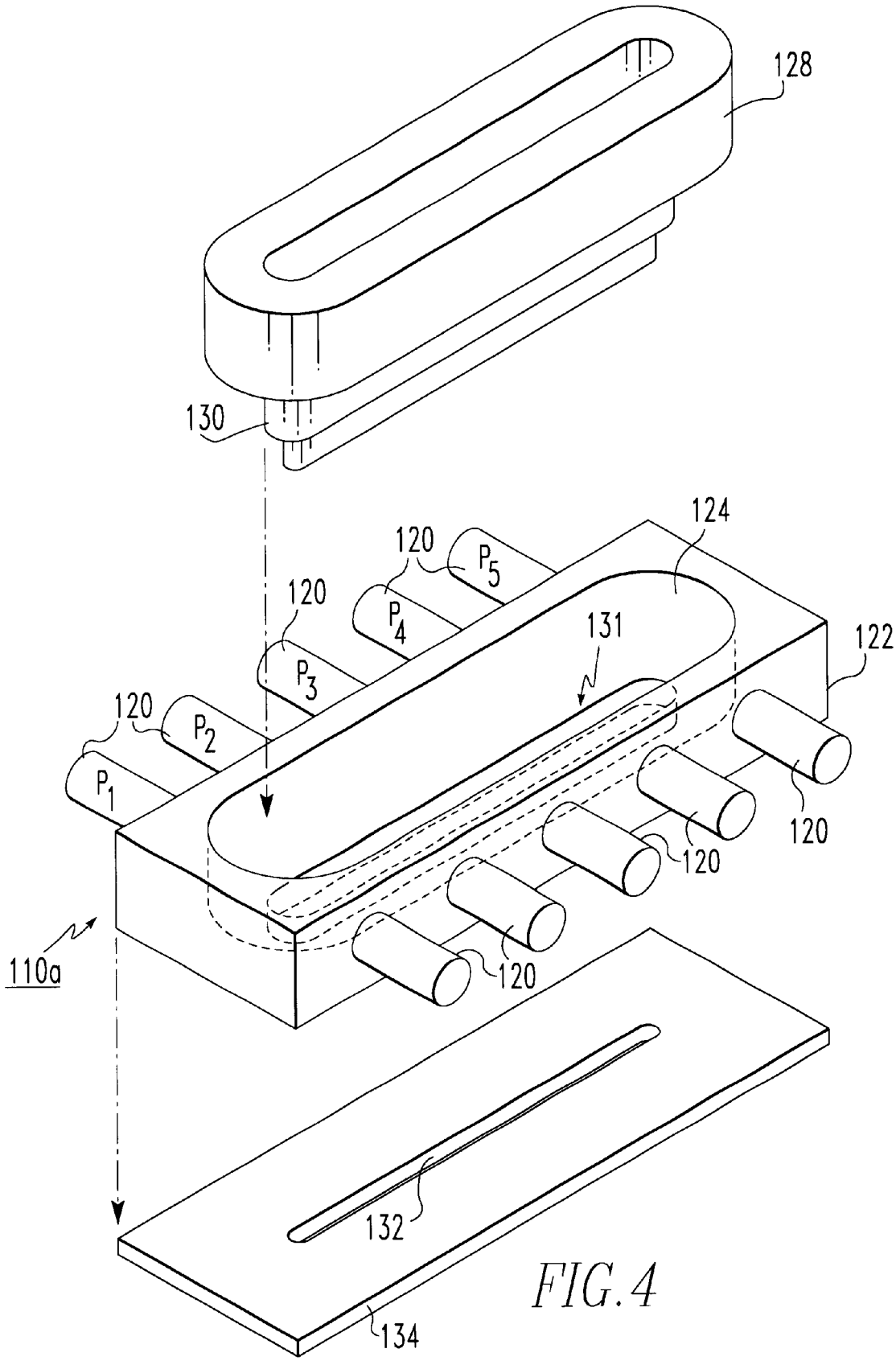
FIG. 4 is an isometric exploded schematic representation of an elongated nozzle and plenum that has been partitioned with internal baffles or partitions and suppliable with individual gaseous streams provided under different pressures with a channel member.
Figure 5:
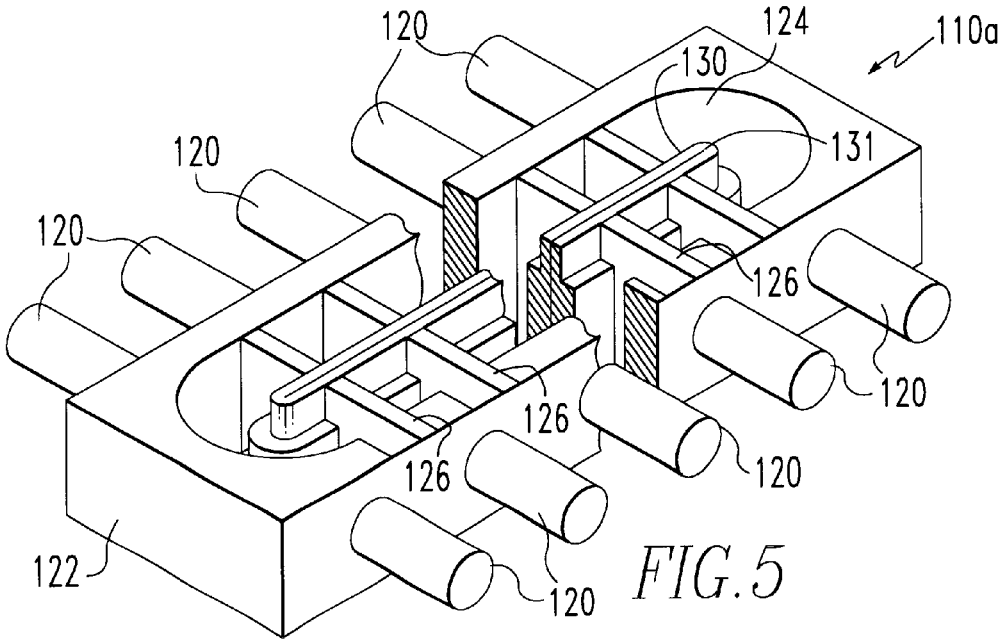
FIG. 5 is a reverse view of the nozzle-plenum of FIG. 4 showing the internal baffles or partitions.

The velocity of a gas stream across the width of a linear nozzle is produced and controlled by the pressure of the gas supplied to the nozzle. By adjusting gas pressure across the nozzle width, the profile, i.e., a gas plume 116*a,* can be changed. FIGS. 4 and 5 show a sectionalized, elongated nozzle 110*a* in which gas pressure and velocity can be selectively changed and controlled according to the invention. The lines midway through these depicted nozzles are meant to show that the invention may contain many more chambers than are actually depicted in the accompanying Figures. With respect to the fractionalized nozzle so depicted, gas is supplied thereto by a plurality of conduits 120 connected to a housing structure 122. The housing structure has an interior 124 that provides an elongated plenum for receiving gas flows from the ends of the conduits connected to the housing. The gases are directed to the conduits from a supply thereof (not shown) under varying pressures to effect the plume 116*a* shown in FIG. 3 of the drawings. In the preferred embodiment shown in FIG. 4, numerals $P_1$ to $P_5$ are used to designate five pressures of the gas flow through the five conduits 120 depicted. The gas pressure combination necessary to effect the uniform mass flow of fluid material 112*a* on a planar substrate would have essentially equal pressures near the opposed ends ($P_1$ and $P_5$) of the linear nozzle, and equal pressures in the middle sections of the nozzle; the two sets of pressures are not equal to each other, however. Rather, the pressure at the ends of the nozzle are lower than the pressures adjacent the middle portion of the nozzle. The result is the velocity profile 116*a* of FIG. 3.

Figure 6:
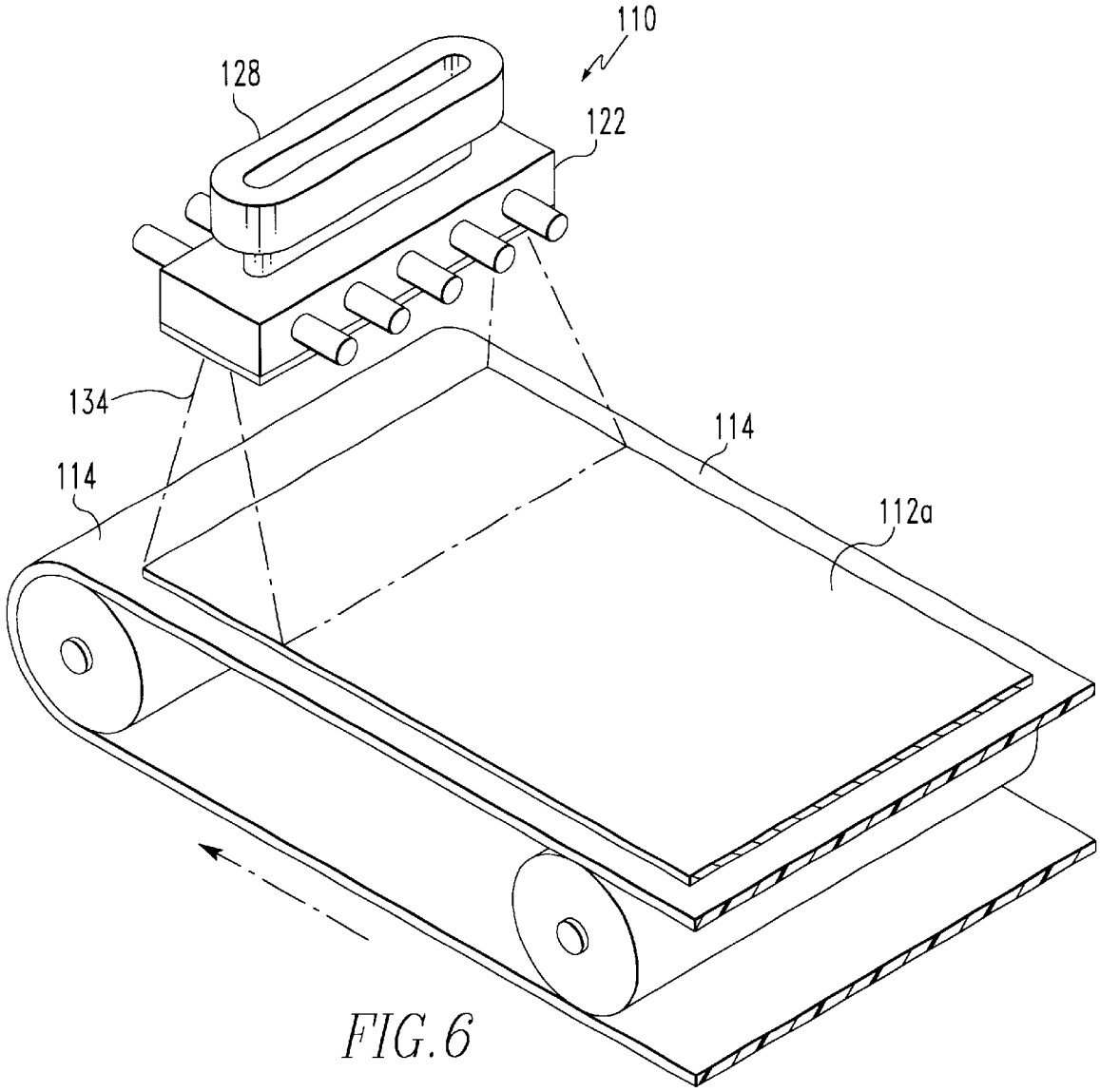
FIG. 6 is a diagrammatic representation of an apparatus for depositing molten metal, or any other depositable material, on a traveling substrate to make a solid sheet- or plate-like product from the nozzle of FIG. 5.

To better control these pressures and the resultant gas velocity profile 116*a* the plenum 124 of housing 122 can be provided with baffles or partitions 126, as seen in FIG. 5 of the drawings. The partitions extend crosswise of the nozzle and plenum length between elongated walls of housing 122 and the elongated walls of an interior, vertical member 131. Such partitions may be evenly spaced, or more preferably unevenly spaced apart as better seen in the subsequent views of FIGS. 5 and 7. The partitions provide side-by-side chambers that permit control of the velocity distribution of gas exiting the chambers through an aperture 132 (FIG. 4) discussed in detail hereinafter. Channel member 128 receives the material of deposit 112 in a fluid or molten form in the case of depositing metal on a substrate, for producing sheet and plate. The channel member is best seen in the exploded view of FIG. 4. Channel member 128 fits inside a built-in sleeve 131 of housing 122, having a lower narrow neck portion 130 that enters and resides in plenum 124. The lower end of the channel member has an elongated opening 136 (better shown in FIG. 7), and extends to and through an elongated opening 132 provided in a lower face plate 134. Plate 134 closes the lower face of the plenum and housing around channel end 131 and thereby provides a narrow continuous closed loop aperture 137 (FIG. 7) that is elongated in the length direction of housing 122 and channel member 128. Such an opening provides a curtain of gas in the configuration of the elongated closed loop of aperture 137 when gas is directed into plenum 124 that is directed from the plenum and towards a surface or substrate 114 (FIG. 6). In FIG. 5, the plate is removed from housing 122 to expose partitions 126 and vertical member 131.

As further seen in FIG. 5, the ends of one or more conduits 120 are located between two consecutive partitions 126 to appropriately locate the flow of gas through the side-by-side chambers of plenum 124 and out of the continuous aperture 137. This "location" of gas flow through the plenum and chambers and out of the continuous aperture 137 in combination with appropriate gas pressures in the chambers provides the ability to tailor the gas plume in a manner that controls the thickness of the material 112 deposited on a substrate.

"Tailoring", in accordance with this invention, can be accomplished by: (a) adjusting the gas pressures through the respective conduits 120; or (b) adjustably mounting partitions 126, which are preferably laterally moveable in the plenum, then securing the partitions in place before the nozzle is used; or (c) variably changing gas aperture slit size 151 on modified plate 150 along the length of the nozzle as shown in FIG. 8C; or (d) combinations of (a), (b) and (c) above. In the more preferred embodiment, combinations (a) and (b) are used. Gas pressures are effected via traditional methods common in many industries. The partitions can be effected, for example, by providing each partition or baffle with a set screw (not shown). To adjust one or more of the partitions, face plate 134 is simply removed from housing 122 and the set screws loosened. The partitions are then manually moved laterally in the plenum to locate the partitions relative to the ends of conduits 120. The set screws are then tightened and face plate 134 returned and secured to the bottom of housing 122.

Figure 7:
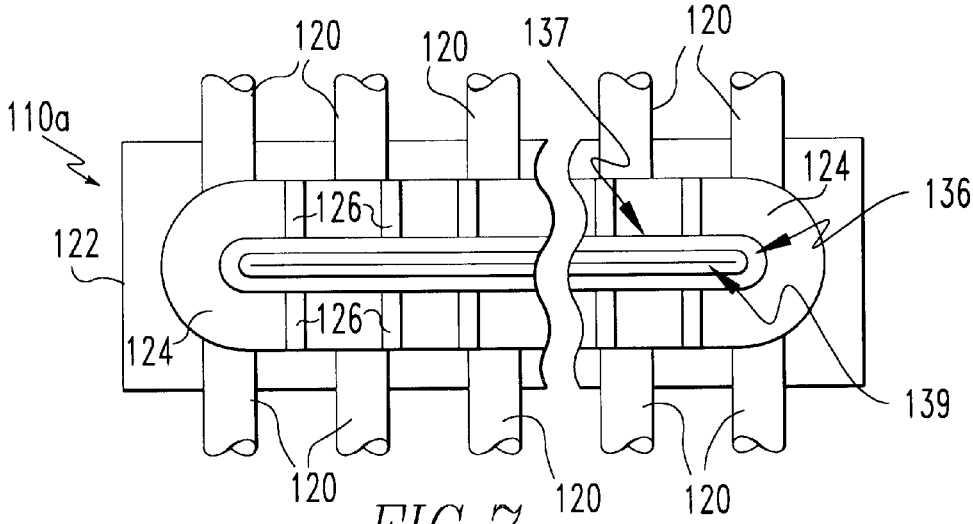
FIG. 7 is a top view of the nozzle plenum of FIG. 5.

In the special case of depositing molten metal supplied to the upper end (entrance) of channel member 128, the metal exits the lower elongated opening 131 of the member, is atomized by a continuous curtain of gas flow exiting the continuous aperture 136, which surrounds the flow of metal from opening 139, and is deposited on a surface 114. As best seen in FIGS. 5 and 7, the opening 139 is in the form of one or more longitudinally aligned slits. The opening 139 should be sufficiently large to avoid plugging from metal inclusions or freezing of the metal yet narrow enough to maintain efficient atomization of the metal. In one embodiment, the opening 139 is about 0.015–0.04 inch wide.

By appropriate partition adjustment, or by knowing and controlling the pressure of the gas flow in conduits 120, a gas plume 116*a* can be provided that does not assume a circle or arcuate configuration before reaching its substrate surface 114. In this manner, the gas flow remains linear in its movement to the surface, and entrains the liquid material exiting nozzle opening 139 in a linear manner such that a uniform mass of liquid material is laid down on the surface. If the nozzle extends crosswise over a surface, the liquid material is evenly deposited across the width of the surface. If the nozzle and surface are moved relative to one another, either by moving the nozzle, the surface (as in FIG. 6), or both, the deposit of liquid material 112*a* is generally deposited evenly crosswise and lengthwise of a surface 114 when relative movement is maintained substantially constant. In FIG. 6, surface 114 is shown as a solid belt that provides a planar surface upon which molten metal can be deposited and solidified to provide a cast metal sheet or plate product 112*a* of constant gauge (thickness). The length of the cast product 112*a* can be that of the length of belt 114. Hence "long" sheets of material can be rapidly produced having a desired gauge and width, as determined by the length of opening 139. Liquid flow rates passing through channel member and the velocity of gas flow through plenum 124 are sufficient to provide a sheet or plate product at rates higher than conventional axisymmetric nozzles.

Figure 8A:
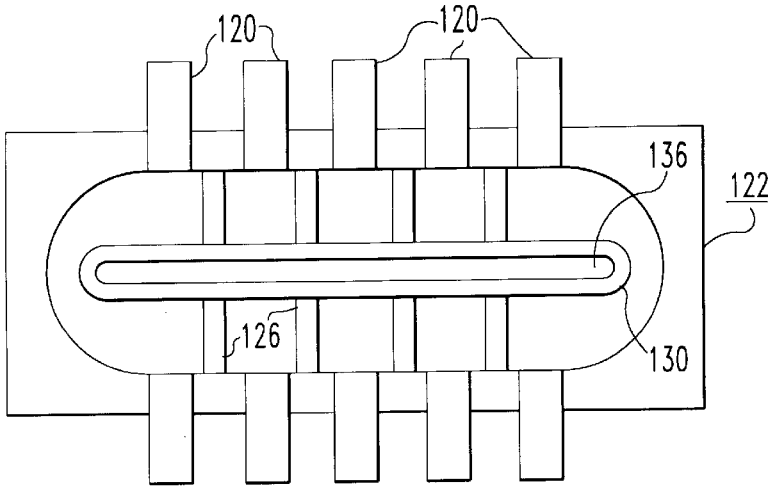
FIGS. 8*a* through 8*c* are top views of three representative nozzle, baffle (or partition) and aperture configurations in accordance with this invention.
Figure 8B:
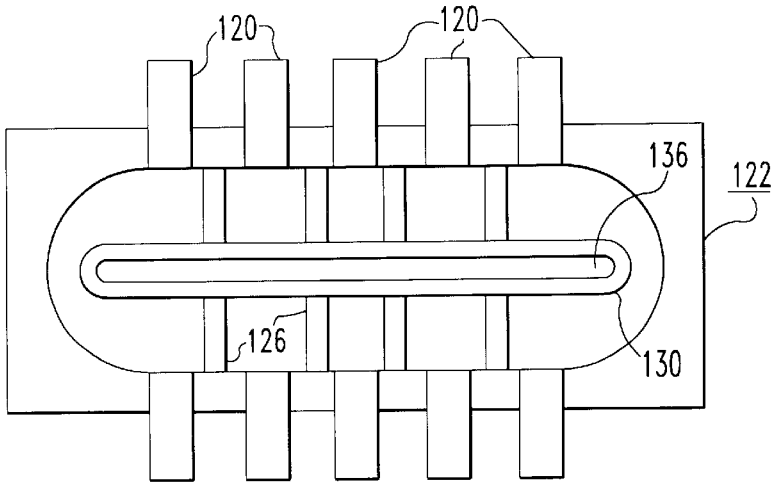
Figure 8C:
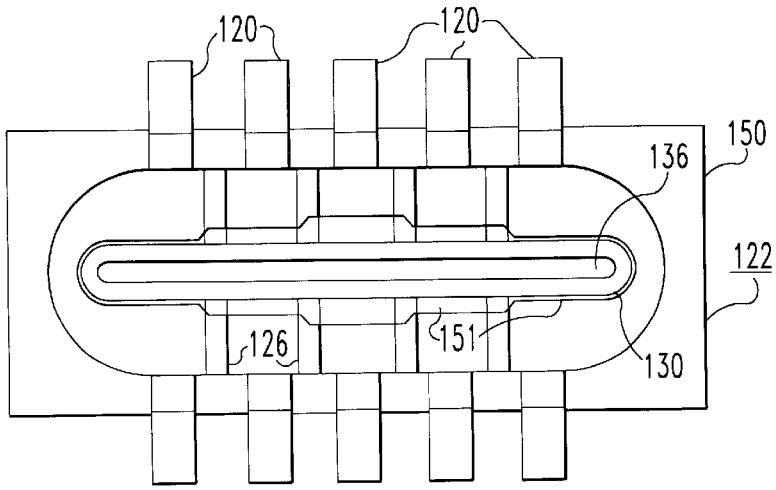

Three representative nozzle and partition (or baffle) configurations are shown in accompanying FIGS. 8*a,* 8*b* and 8*c*. In the first of these, FIG. 8*a,* partitions 126 are evenly spaced apart. In the second, more preferred embodiment, FIG. 8*b,* baffles or partitions 126 are unevenly spaced apart. In FIG. 8*c,* the nozzle housing operates at a single gas pressure, $P_e$, with modified plate 150 in place. Within that nozzle configuration, there are no separate chambers but rather side-by-side zones through which varying gas velocities are delivered. Variably sized gas exit slits 151 are shown in plate 150.

Figure 9:
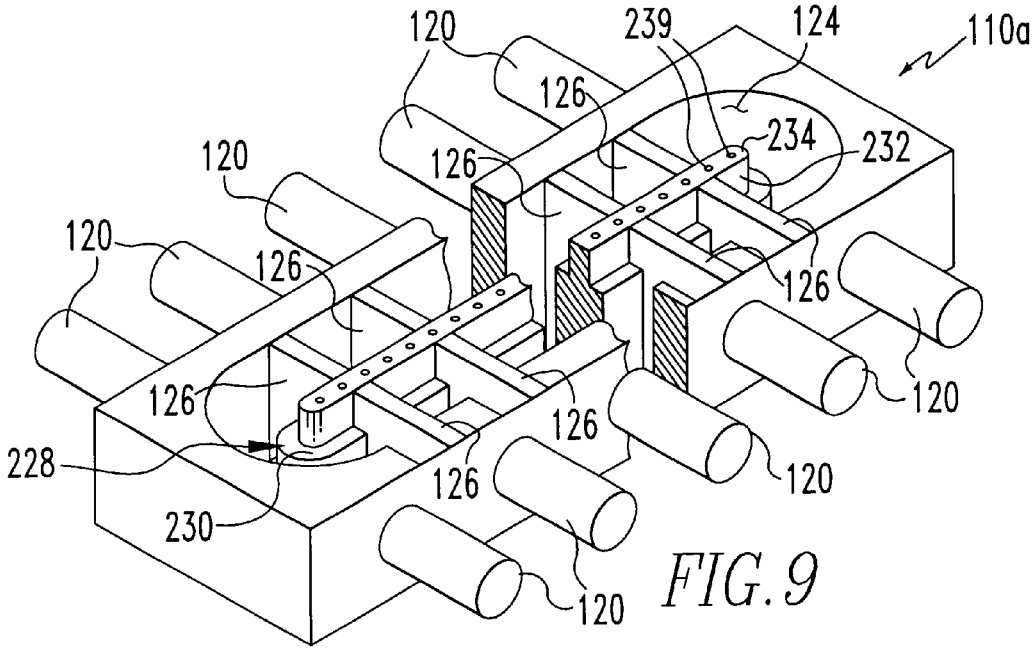
FIG. 9 is an isometric exploded schematic representation of an elongated nozzle and plenum that has been partitioned with internal baffles or partitions and suppliable with individual gaseous streams provided under different pressures with an alternative channel member.
Figure 10:
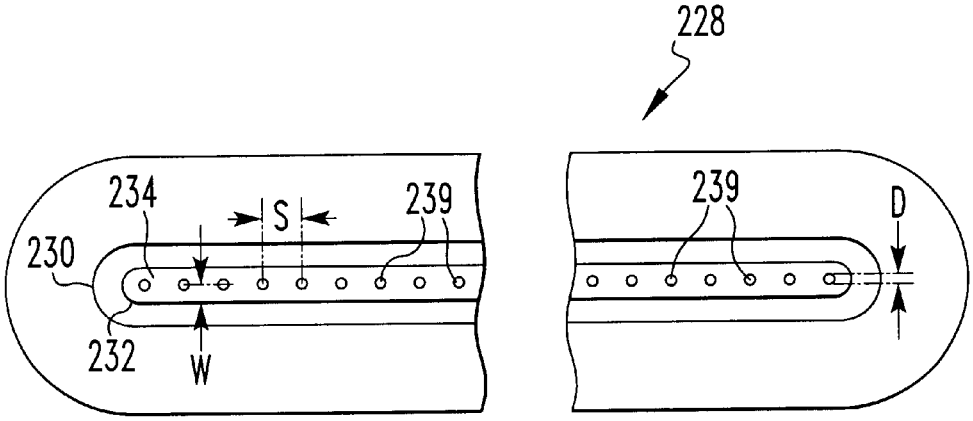
FIG. 10 is a plan view of the underside of the channel member shown in FIG. 9.

FIGS. 9 and 10 show an alternative channel member 228. Channel member 228 is similar to channel member 128 and includes a first lower neck portion 230 and a second lower neck portion 232 with a nozzle face 234. The length of the nozzle face 234 determines the width of a sheet produced by the nozzle and may be about 1–80 inches. The width of the nozzle face 234 affects the efficiency of atomization of the liquid; greater widths of the nozzle face 234 reduces atomization efficiency. However, smaller widths render the nozzle face 234 prone to breakage. A preferred width of the nozzle face 234 which avoids these problems when depositing molten metal is about 3/16–3/4 inch wide, more preferably 3/8 inch wide.

The nozzle face 234 defines a linear array of apertures 239 in place of the opening (slits) 139 defined in the channel member 128. The apertures 239 may be spaced apart regularly or randomly and may be of various sizes and shapes. The configuration of the apertures 239 is determined by selecting a desired liquid flow rate, e.g. the metal deposition rate. The apertures 139 are sized sufficiently large for the material being deposited to avoid plugging by inclusions and freezing or the like, yet provide for uniform distribution of metal over the nozzle face 234 with uniform atomization of the liquid material. For convenience of machining in the nozzle face 234, the apertures may be circular and spaced equidistant from each other and from the sides and ends of the nozzle face 234. In a particularly preferred embodiment, the apertures 239 have a diameter D of about 0.08–0.11 inch. The distance S between the center points of each aperture 239 is preferably about twice the distance W between a center point of an aperture 239 and the side of the nozzle face 234. For nozzle faces longer than about 2 inches, the spacing of the apertures is more critical to the metal deposition profile. For example, spacing the apertures more than 2 inches apart in nozzle faces which are relatively long (e.g. over about 4 inches) will affect the deposit profile. Higher ratios of gas-to-metal flow rates allow for greater distances between the apertures 239 than for lower ratios of gas to metal flow rates. It is also possible to tailor the deposition profile based on the spacing of the apertures 239 as determined by the metal flow rate relative to each 2 inch zone.

The apertures 239 are less prone to plugging during casting from inclusions in molten metal than the slits 139 which are typically sized 0.02–0.04 inch wide. While freezing of metal passing through the channel member 139 can occur, the apertures 239 are sized to avoid this problem. The nozzle face 234 is readily machined from a variety of materials, including metals and ceramics, and is dimensionally stable due to the bridging effect of the nozzle face material between each aperture 239. Apertures 239 having a diameter of about 0.08–0.11 inch have been found to produce similar flow and casting results as the slits 139 having a width of 0.02–0.04. The plurality of apertures 239 spaced apart by the distance S provides a uniform curtain of atomized liquid similar to the curtain of gas produced using the channel member 128.

The invention described herein has already been tested with water and molten aluminum alloys including 3XXX, 6XXX, 2XXX and 7XXX series (Aluminum Association designations). Such alloys are typically used in the automotive and aerospace industries. On a less preferred basis, this invention can be used to deliver to a substrate a paint, coolant, protective coating and/or irrigant. Representative examples of said materials include: glycol; other molten metals like copper, tin, lead, zinc, iron, nickel and combinations thereof; epoxy-based coatings; vinyl-based coatings, and/or liquid fertilizers. Any of the materials otherwise sprayed in accordance with traditional atomization processes may also be applied through this nozzle configuration.

Those knowledgeable in the art will recognize other means for accomplishing the main goal of this invention, that being to modulate the gas velocity profile downstream of the nozzle through which atomized materials are passed for eventual substrate deposit. This invention also covers the method of operating nozzle zones at substantially the same pressure, $P_e$, but through differently sized gas slits or openings; or by operating the nozzle at both different pressures and opening sizes.

Since the exiting gas pressures of this invention are generally greater than atmospheric, these gases expand. This invention exploits the foregoing and thereby actually "tailors" the mass flow of the gas exiting the zones (not necessarily physically partitioned), chambers or physically compartmentalized nozzles.

Having described the presently preferred embodiments, it is to be understood that the invention may be otherwise embodied by the scope of the claims appended hereto.

What is claimed is:

1. A nozzle for depositing a fluid material on a substrate, said nozzle comprising:

(a) a housing defining a plenum for receiving a gaseous medium that entrains the fluid material in a gaseous medium stream, said plenum receiving a channel member for receiving the fluid material, said channel member having a nozzle face defining a linear array of apertures for directing the fluid material into the gaseous medium stream and toward the substrate; and (b) means for supplying the gaseous medium to the channel member in a manner that compensates for a tendency of the gaseous stream to assume an axisymmetric configuration after leaving the nozzle but before reaching the substrate.

2. The nozzle of claim 1 wherein said apertures are about 0.08 to 0.11 inch in diameter.

3. The nozzle of claim 2 wherein a distance between each said aperture and each side of said nozzle face is about equal to half of a distance between each said aperture.

4. The nozzle of claim 1 wherein said apertures are evenly spaced apart.

5. The nozzle of claim 1 wherein said apertures are unevenly spaced apart.

6. The nozzle of claim 1 wherein said plenum is divided into a plurality of side-by-side chambers by a plurality of spaced apart, separately adjustable partitions.

7. The nozzle of claim 6 wherein the partitions are unevenly spaced apart.

8. The nozzle of claim 1 wherein the fluid material is a molten metal.

9. The nozzle of claim 8 wherein the molten metal is an alloy selected from the group consisting of aluminum, copper, tin, lead, zinc, iron, nickel and combinations thereof.

10. The nozzle of claim 9 wherein the molten metal is an aluminum alloy.

11. The nozzle of claim 1 wherein the fluid material is selected from the group consisting of a coolant and a protective coating.

12. The nozzle of claim 11 wherein the fluid material is a paint.

13. A nozzle for depositing a molten metal on a substrate having a substantially planar surface to make a metal sheet or plate product therefrom, said sheet or plate product having a substantially uniform crosswise thickness, said nozzle comprising:

(a) a channel member for receiving the molten metal and a plenum for receiving a gaseous medium that entrains the molten metal in said gaseous medium after the molten metal and gaseous medium leave the nozzle, said channel member having a nozzle face defining a linear array of apertures for directing molten metal from the channel member into the gaseous medium and toward the planar surface; and (b) a means for directing the gaseous medium from the plenum in a manner that compensates for the tendency of a gaseous medium to assume an axisymmetric configuration after leaving the nozzle and before reaching the substrate.

14. The nozzle of claim 13 wherein said apertures are about 0.08 to 0.11 inch in diameter.

15. The nozzle of claim 14 wherein a distance between each said aperture and each side of said nozzle face is about equal to half of a distance between each said aperture.

16. The nozzle of claim 13 wherein said apertures are evenly spaced apart.

17. The nozzle of claim 13 wherein said apertures are unevenly spaced apart.

18. The nozzle of claim 13 wherein said plenum is divided into a plurality of side-by-side chambers by a plurality of spaced apart, separately adjustable partitions.

19. The nozzle of claim 13 wherein the molten metal is an alloy selected from the group consisting of aluminum, copper, tin, lead, zinc, iron, nickel and combinations thereof.

20. The nozzle of claim 19 wherein the molten metal is an aluminum alloy.

* * * * *